United States Patent [19]

Hinsey et al.

[11] Patent Number: 5,052,630

[45] Date of Patent: Oct. 1, 1991

[54] METHOD AND APPARATUS TO REDUCE MATERIAL

[75] Inventors: Michael E. Hinsey, Parker; Avon E. Bathe, Dallas, both of Tex.

[73] Assignee: MAC Corporation, Grand Prairie, Tex.

[21] Appl. No.: 485,595

[22] Filed: Feb. 27, 1990

[51] Int. Cl.[5] ..... B02C 18/24

[52] U.S. Cl. ..... 241/36; 241/243; 241/295

[58] Field of Search ..... 241/295, 36, 242, 243, 241/236, 30, 32

[56] References Cited

U.S. PATENT DOCUMENTS

| | | | |
|---|---|---|---|
| 2,853,247 | 9/1958 | Anderson . | |
| 2,970,780 | 2/1961 | Bowen . | |
| 3,473,742 | 10/1969 | Montgomery . | |
| 3,486,704 | 12/1969 | Persky . | |
| 3,578,252 | 5/1971 | Brewer . | |
| 3,708,127 | 1/1973 | Brewer | 241/32 |
| 3,762,655 | 10/1973 | Brewer | 241/32 |
| 3,840,187 | 10/1974 | Brewer | 241/32 |
| 3,866,844 | 2/1975 | Montgomery . | |
| 3,868,062 | 2/1975 | Cunningham et al. . | |
| 3,893,635 | 7/1975 | Brewer | 241/243 |
| 3,951,346 | 4/1976 | Brewer | 241/32 |
| 4,000,858 | 1/1977 | Rudzinski . | |
| 4,034,918 | 7/1977 | Culbertson et al. . | |
| 4,046,324 | 9/1977 | Chambers . | |
| 4,059,236 | 11/1977 | Brewer | 241/243 |
| 4,082,232 | 4/1978 | Brewer | 241/236 |
| 4,099,678 | 7/1978 | Brewer | 241/243 |
| 4,125,228 | 11/1978 | Brewer | 241/243 |
| 4,162,770 | 7/1979 | Lewis . | |
| 4,176,800 | 12/1979 | Brewer . | |
| 4,205,799 | 6/1980 | Brewer . | |
| 4,349,159 | 9/1982 | Hardwick et al. . | |
| 4,350,308 | 9/1982 | Brewer . | |
| 4,385,732 | 5/1983 | Williams . | |
| 4,394,983 | 7/1983 | Ulsky . | |
| 4,452,400 | 6/1984 | Williams . | |
| 4,560,110 | 12/1985 | Burda . | |
| 4,600,158 | 7/1986 | Matoba . | |
| 4,601,430 | 7/1986 | Skinner | 241/243 X |
| 4,793,561 | 12/1988 | Burda . | |
| 4,927,088 | 5/1990 | Brewer . | |

FOREIGN PATENT DOCUMENTS

| | | | |
|---|---|---|---|
| 24852 | 8/1919 | Denmark | 241/243 |
| 377313 | 6/1923 | Fed. Rep. of Germany | 241/243 |

OTHER PUBLICATIONS

Bulletin 86-10-73, "The Marvelous Montgomery K. C. Model Eat-Rite Hog", printed by Jacksonville Blow Pipe Company.

*Primary Examiner*—Mark Rosenbaum
*Attorney, Agent, or Firm*—Klarquist, Sparkman, Campbell, Leigh & Whinston

[57] ABSTRACT

This invention relates to a shredder which has a single rotating shaft with a plurality of large and small diameter blades in a side-by-side relationship down the length of the shaft. The blades cooperate with fixed shear bars mounted on the first and the second side of the shredder. The shredder can operate in a shredding mode in a forward and a reverse direction. The shredder is driven by a hydraulic motor. The hydraulic motor has a control circuitry, which detects an overload condition in either the foward or the reverse direction. Should an overload condition be detected, the shredder will automatically reverse to eliminate the jammed condition. In normal operation, the shredder cycles for a pre-set time period in a first direction, stops, and then cycles for a second pre-set time period in a reverse direction.

3 Claims, 6 Drawing Sheets

FIG. 3
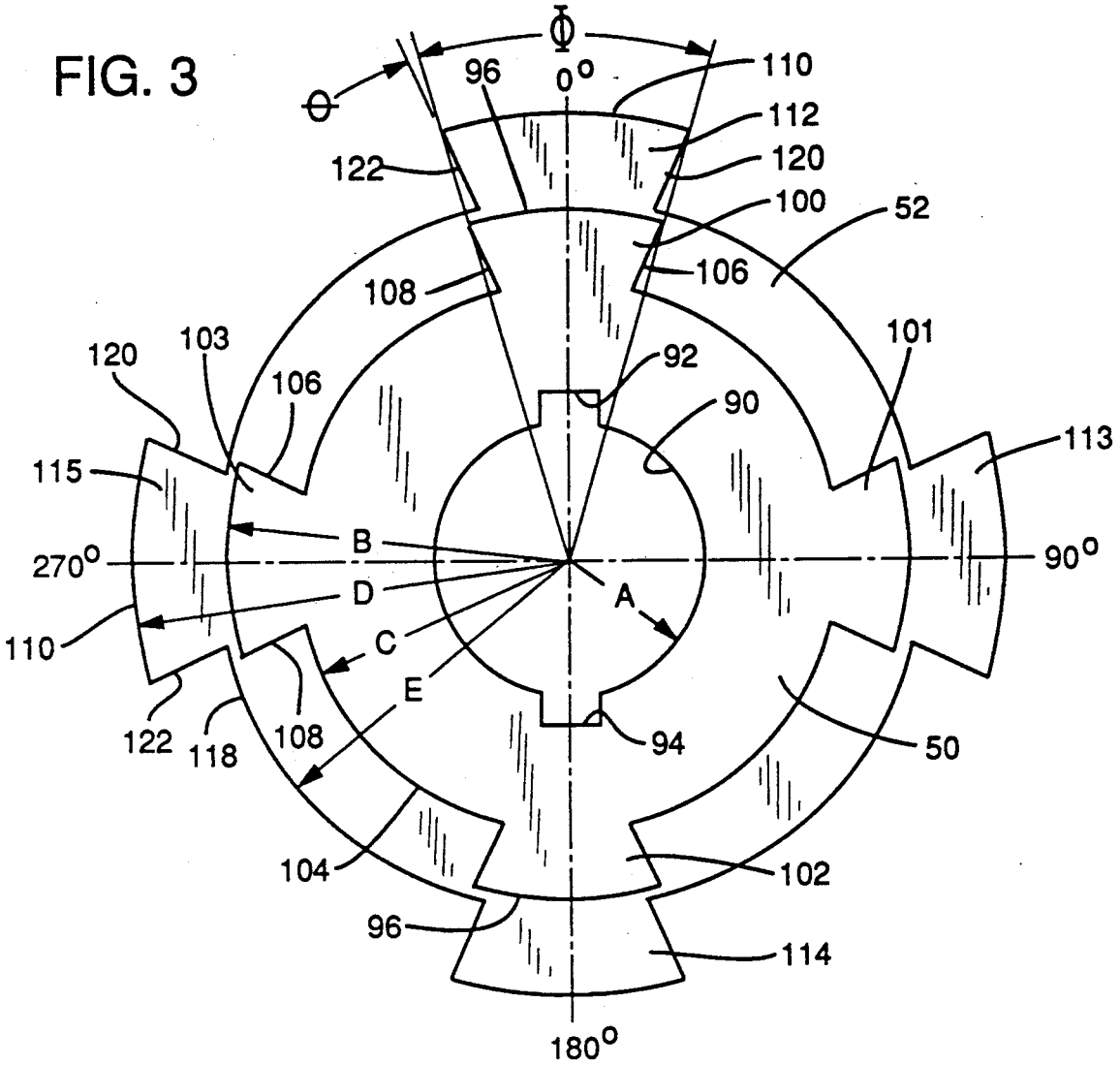
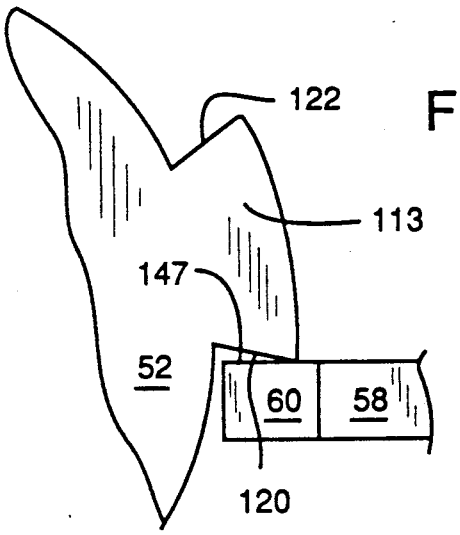
FIG. 13

METHOD AND APPARATUS TO REDUCE MATERIAL

TECHNICAL FIELD

This invention relates to an apparatus to reduce the size of material, and more specifically to a rotary chipper/shredder having a plurality of rotating blades which cooperate with fixed shear bars for reducing the size of the material.

BACKGROUND ART

Most rotary shredding devices of the type disclosed are driven directly by an electric motor through an appropriate speeding reducing transmission. Although such electric drive motors may be provided with overload protection or a reversing circuit, they, nevertheless, tend to burn out when subjected to sudden excessive torque demands, such as when the cutters are jammed with material too hard or too large for them to handle. Because of this deficiency in direct drive electric drives for such rotary shredders, shredders have also been equipped with hydraulic motors using electric motor driven hydraulic pumps to supply fluid pressure to such hydraulic motors. In this way, the hydraulic motor circuit can be designed with pressure relief valves to prevent excessive operating pressures and in this way, isolate the electric pump motor from excessive torque loads.

An example of such hydraulic drive is shown in U.S. Pat. No. 4,034,918, which describes a hydraulic driven dual shaft shredder. The shredder of the 4,034,918 invention is meant to shear or shred the material during one direction of rotation only. Should an overload "jam" condition occur, a pressure switch in the hydraulic circuit of the hydraulic motor is triggered to reverse the rotation of the shafts and thereby clear the jam. After a suitable time period, the shredder again will begin rotating in the forward direction to shred material.

Several shredders have been devised which use only a single rotary shaft working in conjunction with fixed blades or shear bars. One example of a single shaft rotary shredder is disclosed in U.S. Pat. No. 4,394,983 to Ulsky. The Ulsky patent describes a single rotary shaft having blades mounted in a side-to-side relationship down the shaft. Spaces between successive blades allow replaceable fixed rack teeth to fit between the blades. A mechanical linkage allows these blades to swing out of the way in case of an overload condition.

A single shaft rotary chopper is disclosed in U.S. Pat. No. 4,600,158 to Matoba. Again, cutting blades are spaced along a rotary shaft. Cooperating fixed blades are mounted in the gaps between each rotary blade to assist in chopping the material. No overload provisions are provided.

Accordingly, there is a need for a hydraulic drive for a rotary shredder to prevent the burning out of electric motors and furthermore, a hydraulic drive arrangement with a reliable and automatic reversing control to reverse the cutting blades to allow shredding in both directions of rotation of a single rotary shaft to equalize wear and to reverse the direction of rotation upon detection of an overload condition.

BRIEF SUMMARY OF THE INVENTION

It is an object of the invention to provide an improved apparatus for reducing the size of material to a uniform size.

It is a further object of the invention to provide a reversible shredder having a single rotary shaft which can shred material in both directions of travel of the shaft.

It is also an object of the invention to provide a shredder having interchangeable blades with easily replaceable cooperating shear bars.

Another object of the invention is to provide a shredder which can detect an overload condition and reverse direction in response to this overload condition.

Still another object of the invention is to provide a shredder which cycles between a forward direction and a reverse direction to equalize the wear on the blades and shear bars.

According to the present invention, a shredder is provided having a single rotating shaft upon which are mounted a plurality of disk-like cutter blades. The cutter blades include large diameter blades and small diameter blades in side-by-side alternating relationship down the length of the shaft. Each blade has a plurality of teeth spaced about its circumference. The teeth have a forward direction cutting surface and a reverse direction cutting surface. The blades are keyed to the shaft at one of several keyway positions such that the teeth of adjacent blades are progressively angularly displaced over the length of the shaft.

A frame supporting the shaft has a first side and a second side. A plurality of shear bars cooperate with each set of blades. The shear bars are located on the first side of the frame such that they are in face-to-face non-contacting relationship with each blade. Similarly, the second side of the frame has another set of shear bars interacting with each rotary blade. The second set of shear bars are again in face-to-face non-contacting relationship with their respective blades.

A hydraulic motor in a hydraulic control circuit drives the rotary shaft of the shredder. In normal operation, the rotary shaft is advanced in one rotary direction for a set time period. The hydraulic motor is then stopped and reversed, reversing the rotation of the shaft for a similar period of time, thus equalizing the wear on each cutting surface of the teeth.

The hydraulic circuitry detects any overload condition and reverses the rotary shaft to begin shredding in the opposite direction. Should an overload condition occur in the reverse direction, the rotary shaft is again reversed to the forward direction of rotation.

Other objects and advantages of the present invention will be apparent from the following description of a preferred embodiment thereof and from the attached drawings.

BRIEF DESCRIPTION OF THE DRAWINGS

FIG. 3 is a plan view of a small diameter blade overlaying a large diameter blade of the shredder of the present invention.

FIG. 13 is a partial broken away side view of a blade passing cooperating shear bars.

DETAILED DESCRIPTION OF THE INVENTION

Figure 1:
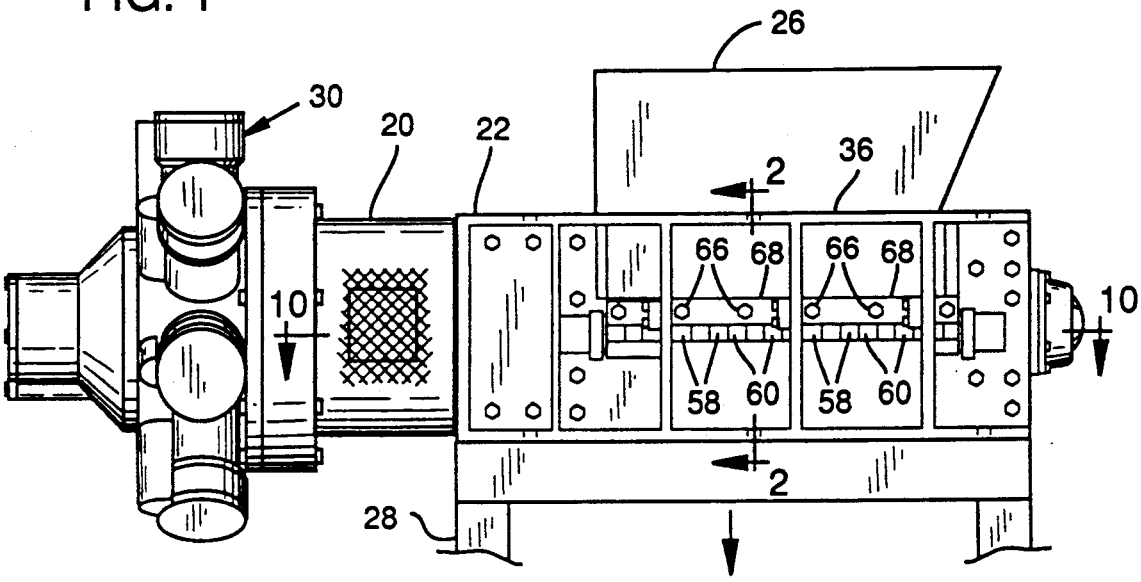
FIG. 1 is a side view of the shredder of the present invention.

Referring now to FIG. 1, a shredder 20 in accordance with the present invention, has a frame 22. Mounted at the top of the frame 22 is a collection bin 26 for receiving material to be shredded. The frame 22 is supported by suitable framework 28 mounted rigidly to the floor. A hydraulic motor 30 is attached to the shredder 20 for driving the shredder. Hydraulic motor 30 preferably is a reversible radial piston-type hydraulic motor although other types of motors may be employed.

Figure 2:
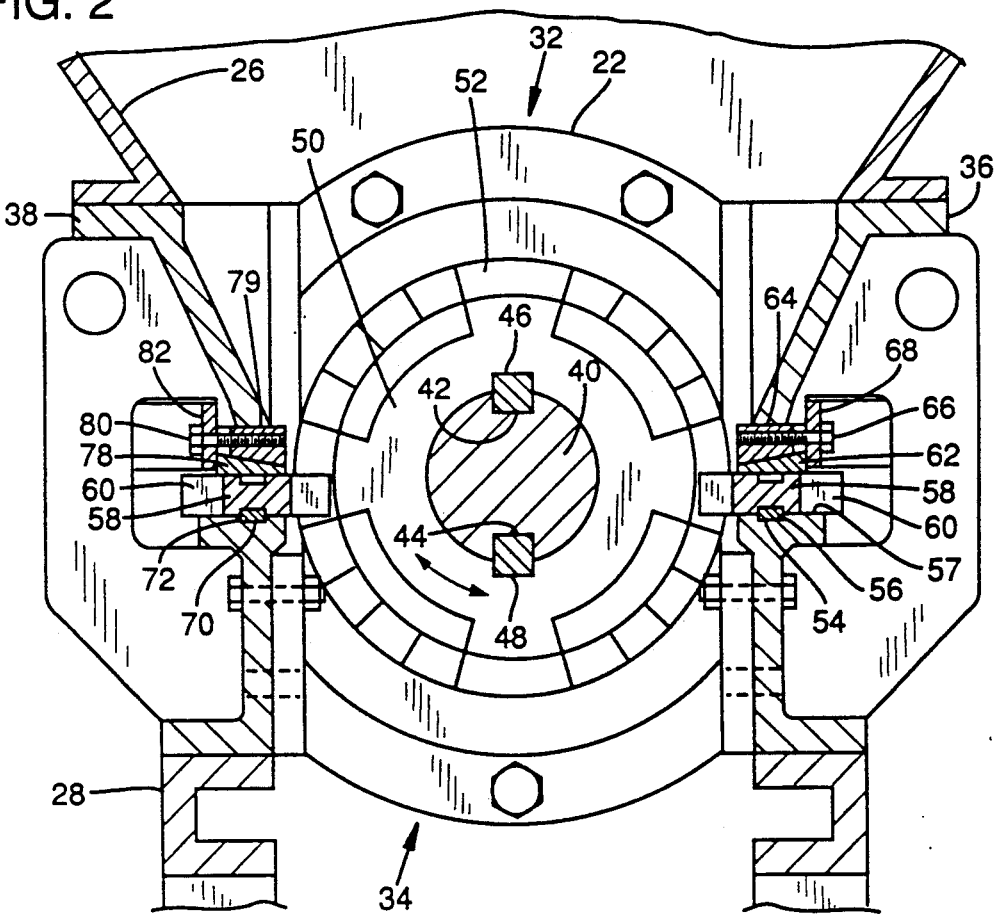
FIG. 2 is an enlarged cross-sectional view of the shredder of the present invention, taken along line 2—2 of FIG. 1.

As shown in FIG. 2, the frame 22 has a first side 36 and a second side 38 which defines a top opening 32 for receiving material to be shredded and a bottom opening 34 for discharging the shredded material. A rotatable shaft 40 (supported by means to be described subsequently) is centrally located between the first side 36 and the second side 38 of frame 22. The rotatable shaft 40 has two longitudely extending axially parallel key seats 42 and 44 milled in the shaft for receiving keys 46 and 48 respectively. A plurality of small diameter circular blades 50 and a plurality of larger diameter circular blades 52 each formed a flat suitable steel plate are mounted on rotatable shaft 40 in a side-by-side alternating small-large-small arrangement. Key seats suitably machined in the blades 50 and 52 receive the keys 46 and 48 to lock the blades to shaft 40 for rotation with the shaft.

The frame side 36 includes a horizontal upwardly facing flat surface portion 57 with a key seat 54 machined in a portion thereof. A key 56 fits within key seat 54. Supported on the surface portion 57 is a first plurality of short shear bars 58 having a key seat 59 (see FIG. 8) receiving the key 56. A second plurality of longer shear bars 60 (see FIG. 9) having key way 61 are also mounted to engage key 56 and be supported on the surface portion 57. The shear bars 58 and 60 are of identical rectangular cross section. The shear bars 58 and 60 are symmetrical so that each may be reversed end-for-end and/or rotated 180° about its longitudal axes for a purpose to be explained. As best shown in FIG. 10, shear bars 58 and shear bars 60 are in a side-by-side alternating relationship down the length of the surface portion 57 of the first side 36 of frame 22 to form a first set of shear bars. A first elongate wedge 62 and a second elongate wedge 64 cooperate with multiple wedge retaining bolts 66 and an elongate wedge retaining plate 68 to lock the shear bars 58 and the shear bars 60 into the first side 36 of the frame 22.

The second side 38 of the frame 22 similarly has a key seat 70 machined into an upwardly facing surface portion 71. A key 72 fits into key seat 70. A first plurality of short shear bars 58′ identical to the short shear bars 58 are adapted to receive the key 72. Similarly, a second plurality of long shear bars 60′ identical to the long shear bars 60 mate with the key 72. The shear bars 58′ and the shear bars 60′ form a second set of shear bars alternating short-long-short bar on the flat portion 71 of the second side 38 of frame 22. As shown in FIG. 10, the short shear bars 58 and 58′ are directly opposite each other as are the longer shear bars 60 and 60′. A first wedge 78 and a second wedge 79 cooperate with wedge retaining bolts 80 and a wedge retaining plate 82 to lock the shear bars 58′ and the shear bars 60′ into the second side 38 of the frame 22.

As can be seen in FIGS. 2 and 10, a small diameter blade 50 cooperates with a pair of opposed larger shear bar 60 and 60′ in a face-to-face noncontacting relationship, that is, each pair of opposed shear bars 60 and 60′ protrude into the shredding chamber toward the adjacent blade 50 but terminate just short of the blades path of rotation. Similarly, each large diameter blade 52 cooperates in a face-to-face noncontacting relationship with a pair of opposed short shear bars 58 and 58′.

FIG. 3 shows a small diameter blade 50 overlaying a large diameter blade 52. Both blades have a bore 90 which is slightly larger than the outside diameter of the shaft 40. The bore 90 is centrally located about the center of the blades as indicated by the radius "A." In the wall of the bore 90 of each of the blades 50 and 52, a pair of opposed key seats 92 and 94 respectively are provided to mate with the keys 46 and 48.

In the illustrated embodiment, the smaller diameter blades 50 are each formed with four teeth 100, 101, 102, and 103 spaced equidistantly about the blade and projecting outwardly from intermediate arcuate blade edge portions 104 having a radius "C." The outer surface 96 of each of the teeth is concentric with the blade and has a radius "B." Each of the side edges 106 and 108 of each tooth is under cut at a small angle "Θ" preferably about 4° with respect to a radius intersecting the terminus of tooth at each end of a tooth. The teeth 100 to 103 are each symmetrical with respect to a radius dissecting the outer surface 96 and each tooth surface 96 preferably subtends an angle "Φ" of about 30° whose apex is the axis of the blade.

The larger diameter blades 52 are of similar construction as is shown in FIG. 3. The blades 52 are each formed with four teeth 112, 113, 114, and 115 equidistantly spaced about the blade. Such teeth being formed with side edges 120 and 122 undercut at an angle "Θ" of about 4°. The teeth 112–115 are each symmetrical with respect to a radius bisecting the outer arcuate surface 110 of the tooth. The surface 110 subtending an angle "Φ" of about 30 having its apex at the axis of the blade. The teeth 112–115 project outwardly from intermediate arcuate blade edge portions 118 that have a radius "E" just slightly greater than the radius "B" of the teeth 100–103 of the smaller blades.

The undercutting of the side edges 106, 108, and 120, 122 of the blade teeth enables the teeth to propel material against the shear bars 58 and 60 and affect shearing of the material rather than punching.

Figure 4:
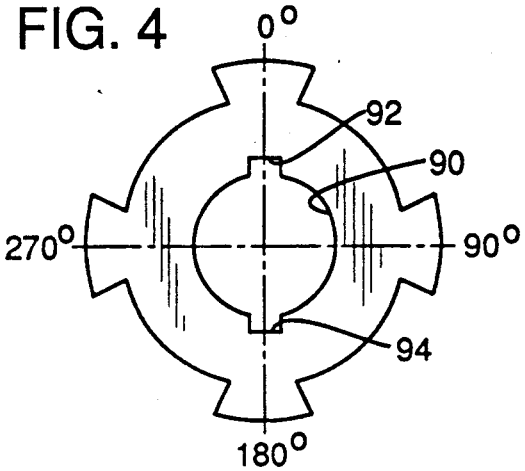
FIG. 4 is a plan view of a blade of the shredder of the present invention having key seats in line with a pair of teeth.
Figure 5:
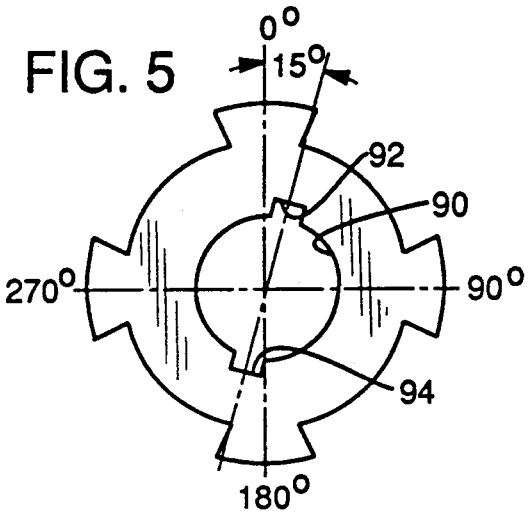
FIG. 5 is a plan view of a blade of the shredder of the present invention having key seats rotated 15° from a line through a pair of teeth.
Figure 6:
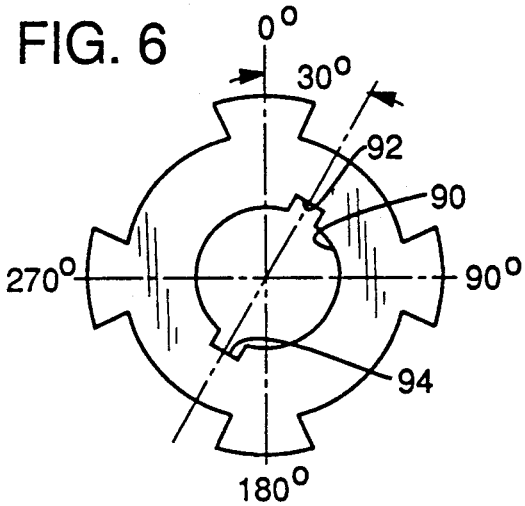
FIG. 6 is a plan view of a blade of the shredder of the present invention having key seats rotated 30° from a line through a pair of teeth.
Figure 7:
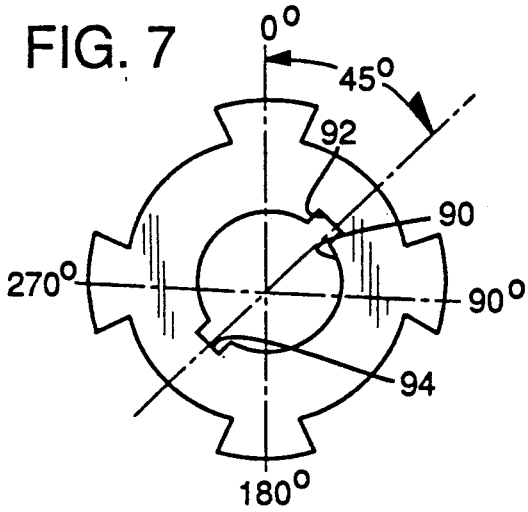
FIG. 7 is a plan view of a blade of the shredder of the present invention having key seats rotated 45° from a line through a pair of teeth.

In accordance with a preferred embodiment of the invention, the blades 50 and 52 are keyed so that the cutting teeth are not aligned with each other longitudely whereby they will not simultaneously be brought into alignment with the shear bars 58 and 60 as the shaft 40 rotates. This is done by positioning the key slots 92 and 94 at differing angular relationship with respect to the teeth of a blade. FIGS. 4–7 illustrate relationships that may be utilized. For example, FIG. 4 shows the key seat 92 and key seat 94 in line with tooth 100 and tooth 102. FIG. 5 shows key seats 92 and 94 rotated at a 15° angle in respect to the centerline between tooth 100 and tooth 102. FIG. 6 shows the key seats 92 and 94 rotated at a 30° angle in respect to the centerline between tooth 100 and 102. FIG. 7 similarly has key seats 92 and key seat 94 rotated at a 45° angle with respect to the centerline between tooth 100 and 102. As can be seen from these diagrams, by reversing or turning one of the blades 50 upside down, that a set of blades can be assembled where the teeth are advanced in relationship to the key seats 92 and 94 by 15° increments. FIG. 4 is 0°, of course. FIG. 5 is 15°, FIG. 6 is 30°, FIG. 7 is 45°. By flipping the blade over, FIG. 6 will give teeth at 60°, FIG. 7 at 75°, and FIG. 4 at 90°. With four teeth per blade, it can be seen how a plurality of these blades along the length of the rotatable shaft 40 can be set such that a tooth will pass by its respective shear bar every 15° of rotation of the shaft 40. This prevents shock loading to the mechanism and allows each tooth to take a bite out of the material to be shredded.

Neglecting for the moment the alternate mounting of small and large blades 50 and 52, the blades are preferably mounted so that their cutting teeth are arranged spirally around the shaft 40. Thus, they impact one-by-one upon material engaged on the shear bars to distribute more evenly the load on the shredding apparatus including the propulsion motor 30°. Thus, a series of blades may be mounted on the shaft in this order: first a blade as in FIG. 4 followed by the blades in FIGS. 5, 6, and 7 in order. Next would follow a blade as in FIG. 6 after it had been flipped over 180°. This would be followed by the blades of FIG. 5 after it had been flipped over. The sequence would start over with a blade of FIG. 4. This will cause the cutting edges to be displaced through circumference such as to be spirally arranged on the shaft 40.

The large diameter blades 52 have their key seats similarly located. A large diameter blade is alternated with a small diameter blade down the length of the rotatable shaft.

Figure 8:
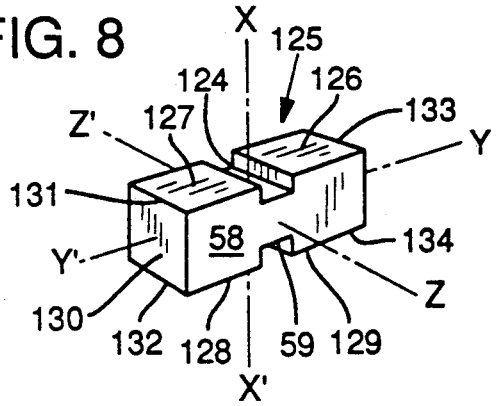
FIG. 8 is a perspective view of a short shear bar of the shredder of the present invention.

As indicated earlier, rectangular shear bars 58 and 60, which may be manufactured from steel bar stock, cooperate with blades 50 and 52. FIG. 8 shows the smaller shear bar 58 having a first key seat 59 in one face 123 thereof and an identical key seat 124 on the opposite face 125 thereof. The face 125 has a first cutting surface 126 and a second cutting surface 127. On the opposite face 123, two additional cutting surfaces 128 and 129 are provided. The opposing surfaces 127 and 128 define with the adjacent end surface 130 a pair of shearing edges 131 and 132. The opposing surfaces 126 and 129 define with the adjacent end surface (not shown but opposite the end surface 130) a pair of shearing edges 133, 134. The edges 131, 132, 133, and 134 of the shear bar 58 cooperate one at a time with rotating blade 52 to shear material. The effective edge 131–134 depends upon the rotation direction of the blade and the end wise position of the bar. It can be seen in FIG. 8 that shear bar 58 has three axis of symmetry. Axis X—X′ is a vertical axis, axis Y—Y′ is a longitudinal axis and axis Z—Z′ is a transverse axis. Shear bar 58 may be rotated about the Z—Z′ axis to place edge 132 in place of edge 133 and edge 134 in place of edge 131. The shear bar may be rotated about the X—X′ axis to place edge 133 in place of edge 131 and edge 134 in place of edge 132. Similarly the shear bar 58 may be rotated about the Y—Y′ axis to place edge 132 in place of edge 131 and edge 134 in place of edge 133.

Figure 9:
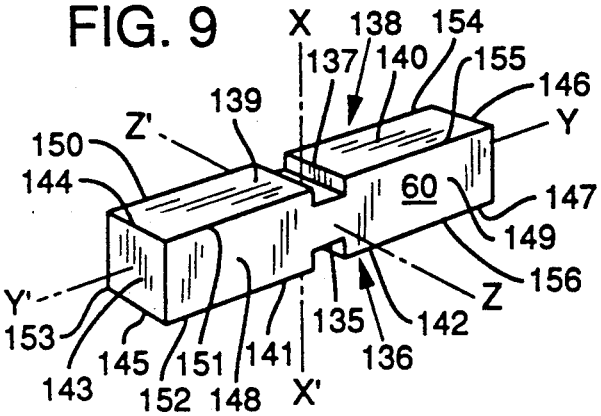
FIG. 9 is a perspective view of a long shear bar of the shredder of the present invention.
Figure 10:
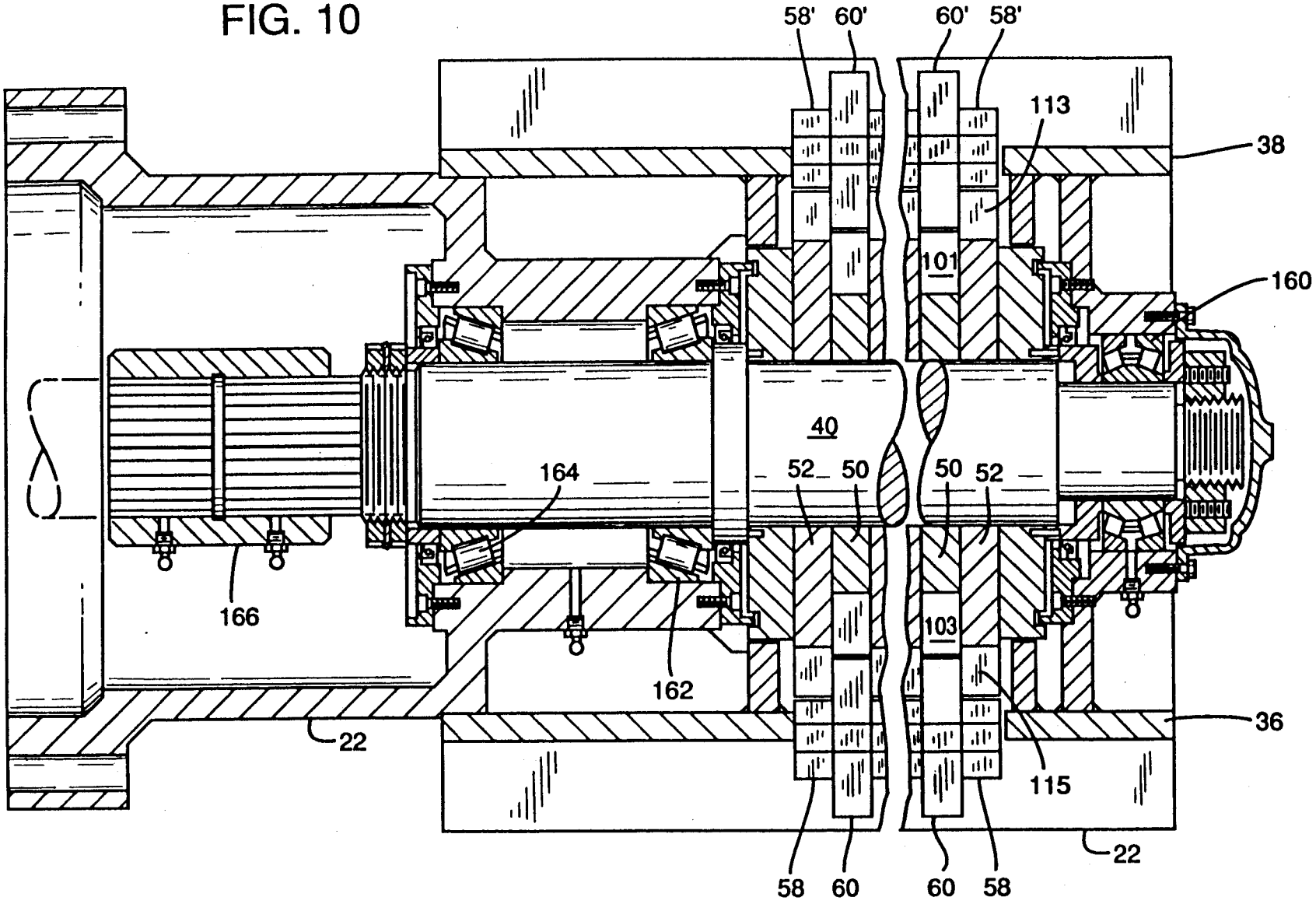
FIG. 10 is a longitudinal cross-section of the shredder of the present invention, taken along line 10—10 of FIG. 1.

Referring to FIG. 9, the shear bar 60 has a key seat 135 formed in a face 136 thereof and a key seat 137 formed in the opposite face 138. The face 136 defines a pair of shear surfaces 141 and 142 while the face 138 defines a pair of shear surfaces 139 and 140 opposite the surfaces 141 and 142 respectively. The shear surfaces 139 and 141 define with the adjacent end face 143 a pair of shear edges 144 and 145. The shear surfaces 140 and 142 define with the opposite end face (not shown) a pair of shear edges 146 and 147.

Since as shown in FIG. 10, the shear bar 60, when mounted, extend inwardly beyond the ends of the shear bars 58 certain portions of the side edges of the bar 60 also define shear edges. These are formed by the intersections of the opposite side faces such as the face 148 with the surfaces 139 and 141. The reversible side shearing edges nearest face 143 in FIG. 9 are indicated at 150, 151, 152 and 153. The other end of shear bar 60, opposite face 143 also has four reversible shearing surfaces, only three 154, 155, and 156 being visible in FIG. 9.

As mentioned previously, the bars 60 are symmetrical which permits their rotation to present fresh shearing edges in operative shearing relationship with the rotating blades 50. Three axis of rotation, X—X′, Y—Y′ and Z—Z′ as shown in FIG. 9 define these axes of symmetry. Roatation of the shear bar 60 about the X—X′ axis replaces shear edge 144 with shear edge 146 and replaces shear edge 145 with shear edge 147. Rotation of shear bar 60 about axis Y—Y′ replaces shear edge 144 with shear edge 145 and replaces shear edge 146 with shear edge 147. Similarly rotation of shear bar 60 about axis Z—Z′ replaces shear edge 144 with shear edge 147 and replaces shear edge 145 with shear edge 146.

Removal of wedge retaining bolt 66 and wedge retaining plate 68 allows the wedges 62 and 64 to be removed. Shear bars 58 and 60 may then be removed, replaced, or reoriented in the first side 36 of the frame 22. Similarly, removal of the wedge retaining bolts 80 and wedge retaining plate 82 allows 78 and 79 to be removed for replacement or reorientation of shear bars 58′ and 60′.

The advantage of the undercut of the edges 120 and 122 on the blade 52 is illustrated in FIG. 13. As therein shown, as a blade 52 rotates clockwise to bring a tooth, such as a tooth 113, between a pair of shear bars 60, the advancing undercut edge 120 first intersects the upwardly facing shear edge 147 at the tip of the edge 120 which thereafter will progressively advance past the edge 147 in a shearing action so as to shear rather than "punch" material engaged between the advancing tooth and the adjacent shear bar 60.

Referring now to FIG. 10, it can be seen that the rotatable shaft 40 is supported in the frame 22 of the shredder 20 by suitable bearings 160, 162, and 164. The rotatable shaft 40 is coupled to the hydraulic motor 30 by a coupling 166. In this figure, it can be seen how the shear bars and the blades alternate down the length of the shaft. A large blade 52 cooperates with a smaller shear bar 58 mounted on the first side 36 of the frame 22 and a small shear bar 58' mounted on the second side 38 of the frame 22. A smaller diameter blade 50 cooperates with the longer shear bar 60 on the first side 36 of the frame 22 and the longer shear bar 60' on the second side 38 of the frame 22. As will be apparent, the smaller diameter blades 50 shear by interaction of their teeth 100–103 with their outer end edge, such as the outer end edge 144 of a longer shear bar 60. The larger blades 52, however, shear by interaction of their teeth 112–115 with outer end edge, such as the edge 131 of a short shear bar 58 and 58' and the exposed side edges, such as edge 144 of adjacent shear bars 60 and 60'.

Hydraulic Circuit

Figure 11:
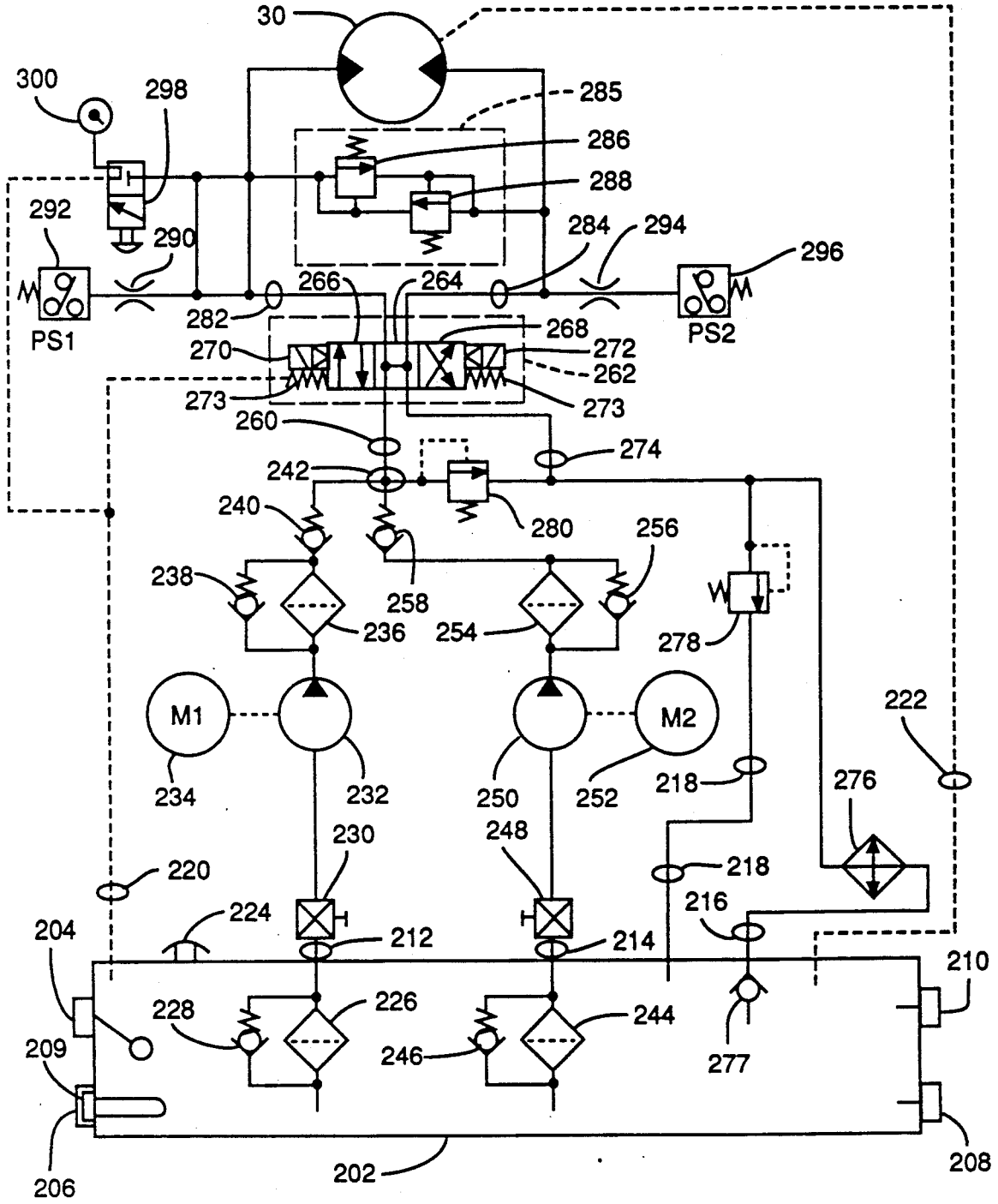
FIG. 11 is a hydraulic circuit diagram of the shredder of the present invention.

In the preferred embodiment of the invention, the chipper/shredder 20 is driven by a hydraulic motor 30 preferably of the radial hydraulic piston type. Referring now to FIG. 11, the hydraulic circuit of the invention includes a tank 202 for holding a suitable hydraulic fluid. The tank has a level detector 204 which is an electro-mechanical device which senses the level of the hydraulic fluid in the tank. When the level of the hydraulic fluid reaches a dangerously low level, a switch internal to the level detector is activated closing a circuit as will be explained in the electrical diagram.

The hydraulic tank also contains an electrical heater 206. The heater 206 maintains the oil in the hydraulic tank at a minimum temperature. Preferably, this temperature is between 50° F. and 80° F. Switch 208 is a temperature safety switch which is normally open. Should the temperature of the hydraulic fluid rise above 170° F., the switch closes shutting down the operation of the pumps. Above 100° F., the switch 209 opens, shutting off power to the electric heater 206. A fan thermostat or third temperature switch 210 is also housed in the hydraulic tank. The function of thermostat switch 210 will be explained during the explanation of the oil cooler. Two supply lines 212 and 214 and four return lines 216, 218, 220 and 222 pass into the hydraulic tank. The hydraulic tank 202 is vented by a vent 224 to prevent a pressure build-up in the hydraulic tank 202.

Supply line 212 draws hydraulic fluid from supply tank 202 through a filter strainer 226. A pressure relief valve 228 by-passes filter strainer 226 in case the filter becomes blocked. A valve 230 allows the hydraulic fluid to flow to a hydraulic pump 232 when valve 230 is open. An electric motor 234 drives the hydraulic pump 232 at a constant speed in one direction. The hydraulic fluid being pumped by the hydraulic pump 232 flows through a filter strainer 236. A pressure relief valve 238 by-passes filter strainer 236 in case the filter becomes plugged. The fluid flow continues through a check valve 240 to a common hydraulic junction 242.

A second supply line 214 draws hydraulic fluid from the fluid tank 202 through a filter strainer 244. A pressure relief valve 246 allows the fluid to by-pass the filter strainer 244 should the filter strainer become plugged. A valve 248 allows the fluid to flow through supply line 214 to hydraulic pump 250. An electric motor 252 drives the hydraulic pump 250 at a constant speed in a single direction. The fluid pumped by hydraulic pump 250 flows through a filter strainer 254. A pressure relief valve 256 allows the hydraulic fluid to by-pass the filter should the filter become plugged. The hydraulic fluid then flows through a one-way check valve 258 to hydraulic junction 242.

The hydraulic junction 242 feeds the hydraulic fluid to a supply line 260. The supply line 260 is connected to a three-position solenoid operated valve 262. The three-position valve 262 has a first position, or neutral position 264. A second position 266 is a forward position and a third position 268 is a reverse position. A solenoid 270 forces the three-way valve from the neutral position 264 to the forward position 266 when solenoid 270 is energized. A second solenoid 272 when energized forces the three-way valve from the neutral position 264 to the reverse position 268. A pair of springs 273 center the three-way valve 262 in the neutral position 264 when neither solenoid 270 nor solenoid 272 is energized. A return hydraulic line 274 is also connected to the three-position valve 262. The return hydraulic line 274 allows the hydraulic fluid to pass through a cooler 276 back into the fluid tank 202 through hydraulic line 216. A pressure relief valve 278 allows the cooler 276 to be by-passed in case the fluid flow is too great or the pressure rises above a preset level. The pressure relief valve is connected to hydraulic line 218 which allows the hydraulic fluid to flow back into the hydraulic tank 202. Another pressure relief valve 280 interconnects hydraulic junction 242 with the return fluid line 274. Pressure relief valve 280 is set to release should the pressure become high enough that damage could occur to the hydraulic pumps 232 and 250.

When the four-way valve 262 is in neutral position 264, fluid pressure from supply line 260 is by-passed through neutral position 264 to return line 274. In this manner, hydraulic motor 30 cannot operate because no differential pressure is applied across hydraulic motor 30.

A hydraulic pressure line 282 and a hydraulic pressure line 284 also are interconnected to the four-way valve 262. When the hydraulic valve 262 is in the neutral position 264, there is no differential pressure between hydraulic line 282 and 284. A safety valve 285 interconnects hydraulic line 282 and 284. The hydraulic safety valve 285 is comprised of two pressure relief valves 286 and 288 placed back-to-back. Should the pressure on either side of the hydraulic circuit, i.e., in hydraulic line 282 or 284, rise to a level that potentially could damage hydraulic motor 30, one or the other of pressure relief valves 286 or 288 would open by-passing the excessive pressure to the other side of the hydraulic circuit.

When solenoid 270 is activated, the four-way valve 262 is forced to the right such that the forward position portion 266 of the three-way valve 262 communicates with the pressure line 260 and with the return line 274. The pressurized hydraulic fluid flows from hydraulic line 260 into hydraulic line 282. The hydraulic fluid passes through the motor 30 to hydraulic line 284 thence down through the four-way valve 262 into fluid line 274. The fluid then is returned to the fluid tank 202.

In this configuration, it can be seen that hydraulic line 282 is the high pressure side and hydraulic line 284 is the low pressure side of the hydraulic circuit. Communicating with the high pressure side 282 is a fixed flow restriction 290. The fixed flow restriction 290 restricts the flow of fluid to a pressure switch 292. The flow restriction 290 tends to dampen out any high pressure spikes to allow pressure switch 292 to detect a jammed condition of the shredder 20. A switch 298 also is interconnected with supply line 282. When switch 298 is activated, the pressure in the hydraulic circuit can be read on gauge 300. When switch 298 is deactivated, any hydraulic pressure in the gauge 300 is allowed to pass to a return line 220. Return line 220 also is interconnected to the three-way valve 266 such that any fluid leakage that occurs in the valve 262 can be passed back to the supply tank 202.

Once solenoid 270 is deactivated, the four-way valve 262 returns to its neutral position 264. In this condition, any differential pressure across the hydraulic motor 30 is relieved, and the fluid is allowed to flow back to the supply tank 202. This allows the motor to gently come to a stop to prevent any inertial damage to the motor during reversal of the hydraulic circuit.

To reverse the hydraulic circuit, solenoid 272 is activated forcing the four-way valve 262 into the third position 268. In position 268, the fluid pressure from supply line 260 is directed to hydraulic line 284. The hydraulic fluid flows through the motor 30 causing the motor to rotate in a reverse direction. The hydraulic fluid passes through the motor 30 to hydraulic line 282 and then to return hydraulic line 274. Here the fluid is passed through the cooler 276 back to the hydraulic tank 202 through line 216. A second fixed flow restriction 294 similar to restriction 290 communicates with hydraulic line 284. A second pressure switch 296 senses the pressure in hydraulic line 284. Should the chipper 20 reach a jammed condition and the hydraulic pressure rise, switch 296 is activated.

Any hydraulic fluid leakage through the motor 30 is collected and returned back to the fluid tank 202 through a return line 222.

Electrical Circuit

Figure 12:
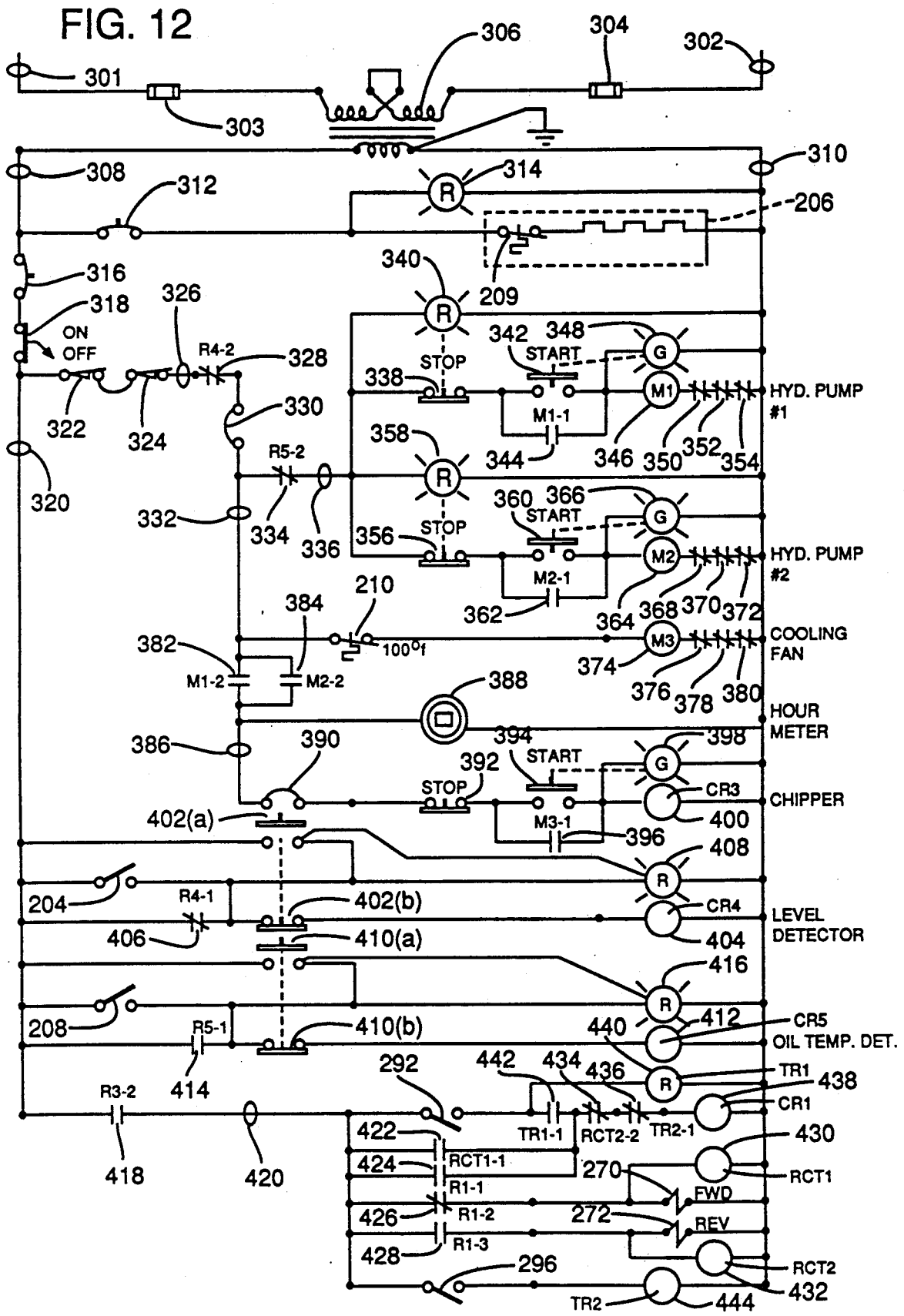
FIG. 12 is an electrical circuit diagram of the shredder of the present invention.

The description of the operation of the electrical circuit should be followed together with the hydraulic circuit shown in FIG. 11. Referring thus to FIG. 12 and FIG. 11, power lines 301 and 302 supply power through fuses 303 and 304 to the primary side of transformer 306. The secondary side of transformer 306 supplies power to lines 308 and 310. For purposes of explanation of the circuits described below, line 308 will be described as the hot line and line 310 will be described as the neutral line.

Hot line 308 feeds power to a circuit breaker 312 and then to the oil heater 206 of the hydraulic circuit of FIG. 11 through a temperature-sensitive switch 209. Temperature switch 209 closes when the temperature of the oil is below 100° F. and is open when the temperature of the oil is above 100° F. Thus, power is supplied to the heater 206 when the temperature of the oil falls below 100° F. When power is being supplied to temperature switch 209, an indicator lamp 314 is lit.

Hot line 308 supplies power through circuit breaker 316 and switch 318 to hot line 320. Switch 318 is the main power sWitch to the shredder. It should be noted that heater 206 is independent of switch 318 and will maintain the temperature of the hydraulic oil in tank 202 above 50° F. even when the shredder is idle.

Hot line 320 also supplies power through switches 322 and 324 to line 326. Switch 322 is integral with valve 230 and is closed when valve 230 is open. Switch 322 is open when valve 230 is closed. Similarly, switch 324 is integral with valve 248 and is closed when valve 248 is open, and open when valve 248 is closed. Thus, both valves 230 and 248 must be open before power is supplied to line 326.

Line 326 feeds electrical power through a normally closed relay contact 328 (R4-2) and jumper 330 to hot line 332. Electrical power is fed from hot line 332 through normally closed relay contact 334 (R5-2) to hot line 336. The function and operation of the normally closed relay contacts 328 and 334 will be explained below. The line 336 feeds electrical power to the hydraulic pump motor circuits. As long as power is being fed to line 336, indicator lamps 340 and 358 are lit.

The first hydraulic pump motor circuit has a normally closed stop switch 338. As long as this stop switch 338 is closed power is fed to a momentary closure start switch 342. Activation of start switch 342 causes power to be fed to motor relay 346 (M1) which activates the electric motor 234 which drives hydraulic pump 232. Electric motor 234 is a three-phase electric motor. Each phase of the motor has a normally closed thermal overload breaker 350, 352, and 354 in line with each power input. Overload of any of the input power lines to the motor 234 will cause the corresponding thermal overload breakers 350, 352, or 354 to open and prevent power from flowing through the motor relay 346. The motor relay 346 also latches relay contact 344 (M1-1) from a normally open condition to a closed condition. Thus, power will continue to flow through motor relay 346 until stop switch 338 is depressed, one of the thermal overload breakers 350, 352, or 354 opens because of an overload condition, or power is removed from line 336. As long as motor relay 346 is energized, green indicator lamp 348 is lit.

The second hydraulic pump motor circuit has a normally closed stop switch 356. As long as this stop switch 356 is closed power is fed to a momentary closure start switch 360. Activation of start switch 360 causes power to be fed to motor relay 364 (M2) which activates the electric motor 252 which drives hydraulic pump 250. Electric motor 252 is a three-phase electric motor. Each phase of the motor has a normally closed thermal overload breaker 368, 370, and 372 in line with each power input. Overload of any of the input power lines to the motor 252 will cause the corresponding thermal overload breakers 368, 370, or 372 to open and prevent power from flowing through the motor relay 364. The motor relay 364 also latches relay contact 362 (M2-1) from a normally open condition to a closed condition. Thus, power will continue to flow through motor relay 364 until stop switch 356 is depressed, one of the thermal overload breakers 368, 370, or 372 opens because of an overload condition, or power is removed from line 336. As long as motor relay 364 is energized, green indicator lamp 366 is lit. Should motor relay 364 become de-energized, red indicator lamp 358 will lit.

Power line 332 supplies power through the second temperature switch 210, which is located in hydraulic tank 202. Temperature switch 210 is a normally open switch, which closes when the temperature of the hydraulic fluid rises above 100° F. Power is fed to motor control relay 374 (M3) when the temperature is above 100° F. Motor control relay 374 (M3) drives a cooling fan which forces air through oil cooler 276. The electric motor controlled by motor control relay 374 (M3) is a three-phase electric motor. Each of the three power lines to the electric motor has a normally closed thermal breaker 376, 378 or 380 associated with each of these power lines. Should an overload condition exist, the respective thermal overload breakers 376, 378 or 380 will open, preventing electrical power from going through motor control relay 374 (M3) and, therefore, shutting off the motor driving the cooling fan.

Power line 332 also supplies power to two normally open relay contacts 382 (M1-2) and relay contact 384 (M2-2). Relay contact 382 (M1-2) is controlled by motor control relay 346 (M1). As long as motor control relay 346 (M1) is energized, relay contact 382 (M1-2) will be closed. Similarly, relay contact 384 (M2-2) is controlled by motor control relay 364 (M2). When motor control relay 364 (M2) is energized, relay contact 384 (M2-2) will be closed. Thus, it can be seen that power will be transmitted from power line 332 to power line 386 only when either motor control relay 346 (M1) and thus, hydraulic pump 232, or when motor control relay 364 (M2) and thus, hydraulic pump 250, is operated. An hour meter 388 operates only when electrical power is supplied to power line 386.

Power line 386 supplies power through a jumper 390 and a normally closed stop switch 392 to a momentary contact start switch 394. When start switch 394 is energized, power is supplied to control relay 400 (CR-3). Control relay 400 energizes relay contact 396 (M3-1) to close relay contact 396 and thereby latch control relay 400 (CR-3) to an "on" condition. As long as power is being supplied to control relay 400 (CR-3), the green indicator lamp 398 will be lit. Should stop switch 392 be depressed, thereby opening the circuit, power will be taken from control relay 400 (CR-3) and relay contact 396 (R3-1) will open, thereby taking the power away from control relay 400 (CR-3) and stopping the chipper, as will be explained below.

Two hydraulic protection circuits are provided, one of which stops operation of the shredder should the fluid level in tank 202 become too low and the second protection circuit stops the shredder should the oil temperature rise above an acceptable level. The first protection circuit is supplied power by hot line 320 to level detector 204. Level detector 204 is a normally open switch. If the level of the fluid in tank 202 becomes too low, switch 204 closes. This supplies power from line 320 to control relay 404 (CR-4). Control relay 404 closes normally open relay contact 406 (R4-1) to continue to supply power to control relay 404. Control relay 404, when energized, opens the normally closed relay contact 328 (R4-2). This eliminates power to line 332, automatically stopping hydraulic pump 232 by de-energizing motor relay 346 (M1) and stopping hydraulic pump 250 by de-energizing motor control relay 364 (M2). Elimination of power to motor control relay 346 and motor control relay 364 opens relay contact 382 (M1-2) and relay contact 384 (M2-2). This, in turn, de-energizes control relay 400 (CR-3). Thus, the hydraulic pumps 232 and 250 and the chipper are stopped until both level detector 204 opens and reset switch 402*a* and 402*b* are depressed. Once level detector 204 is open, depression of reset switch 402*a* and 402*b* causes the power to control relay 404 (CR-4) to be cut off, thus extinguishing red indicator light 408 and closing relay contact 328 to restore power to the hot line 332.

The second hydraulic protection circuit consists of an oil over-temperature detector 208. This detector is a normally open switch which closes if the oil temperature in tank 202 rises above 170° F. When switch 208 closes, power is fed to control relay 412 (CR5). When control relay 412 is energized, normally open relay contact 414 (R5-1) is closed, latching the relay 412 in an operative position. Red indicator lamp 416 is lit when control relay 412 is energized. Control relay 412 (CR5) also moves relay contact 334 (R5-2) from a normally closed position to an open position. This, thus, eliminates all power to line 336. Motor control relay 346 (M1) is deactivated, stopping the motor 234 which drives hydraulic pump 232. Similarly, motor control relay 364 (M2) deactivates motor 252, which stops hydraulic pump 250. Relay contact 382 and 384 both open, eliminating power to line 386. This causes control relay 400 to open, thus stopping the chipper also. Once the temperature of the oil in tank 202 falls below 170° F., switch 208 opens. Depressing reset switch 410*a* and 410*b* causes the power to control relay 412 (CR-5) to be de-energized, causing indicator lamp 416 to go off and power to again be supplied to line 336.

One of the major features of the present invention is control of the hydraulic motor 30, which rotates shaft 40 to effect automatic reversal of its direction of rotation after a predetermined period of time. This is accomplished by supplying power from line 320 through a normally open relay contact 418 (R3-2). Relay contact 418 is closed when control relay 400 (CR-3) is energized, thus supplying power to line 420. Power line 420 supplies power to a forward direction pressure switch 292, a normally open relay contact 422 (RCT-1), a normally open relay contact 424 (R1-1), a normally closed relay contact 426 (R1-2), a normally open relay contact 428 (R1-3), and a second pressure switch 296. During initial operation, power is fed through normally closed relay contact 426 (R1-2) to energize forward direction solenoid 270. As previously explained, solenoid 270 forces electric solenoid valve 262 to one side to allow hydraulic fluid to flow to hydraulic motor 30, rotating shaft 40 in a forward direction. Simultaneously, power is supplied to control timer 430 (RCT-1). This timer continues to time a first time until the time runs out. Once the first time runs out, relay contact 422 (RCT-1) is closed, supplying power through normally closed relay contact 434 (RCT-2) and timer relay contact 436 (TR2-1) to control relay 438 (CR-1). When control relay 438 is energized, normally closed relay contact 426 (R1-2) is opened and relay contact 424 (R1-1) is closed, thereby continuing to supply power to control relay 438. Simultaneously, relay contact 428 (R1-3), which is normally open, is closed by control relay 438. This supplies power to solenoid 272, which forces solenoid valve 262 in the opposite direction to supply hydraulic fluid to reverse the direction of rotation of hydraulic motor 30, thus reversing rotation of shaft 40. Simultaneously, power is fed to control timer 432 (RCT-2). Once control timer 432 has timed a second time thus completing its cycle, electrical contact 434 (RCT-2) is opened, de-energizing control relay 438. Control relay 438, in turn, opens relay 424 (R1-1), closes relay contact 426 (R1-2), and opens relay contact 428 (R1-3). This, then, de-energizes solenoid 272 and energizes solenoid 270 to cause solenoid valve 262 to supply power to rotate the hydraulic motor 30 in a forward direction. During normal operation, the shredder continues to operate first in a forward direction for a first time period until control timer 430 times out, then in a reverse direction for a second time period until control timer 438 times out and to continue reversing direction until some other event occurs.

During forward rotation, should an overload condition be detected by pressure switch 292, the switch will close, supplying power to timer relay 440 (TR-1). This energizes relay contact 442 (TR1-1), supplying power through normally closed relay contact 434 and normally closed relay contact 436 to control relay 438. Control relay 438, as previously explained, when energized, opens relay contact 426 and closes relay contact 428, supplying power to reverse solenoid 272 immediately reversing hydraulic motor 430. The motor continues to revolve in the reverse direction for a third time period until timer relay 440 completes it cycle, whereupon relay contact 442 opens and normal operation resumes.

Similarly, should the shredder be operating in a reverse direction and an overload condition is detected by pressure switch 296, power is supplied from line 420 to timer relay 444 (TR-2). This immediately opens normally closed relay contact 436 (TR2-1), eliminating power to control relay 438. This forces relay contact 426 (R1-2) back to a closed position, supplying power to forward solenoid 270. The motor continues to revolve in the forward direction for a fourth time period until timer relay 444 completes it cycle, whereupon relay contact 436 closes and normal operation resumes.

The above description of one embodiment of the electrical circuit using relay logic is illustrative only. A programmable controller with appropriate input and output circuitry may also be used in place of the relay logic in an alternate embodiment of the invention.

Operation

In order to operate the shredder of the present invention, supply valves 230 and 248 are opened, thereby closing switches 322 and 324. The master power switch 318 is depressed, thereby supplying power to lines 320 and 326. If the hydraulic level as detected by float switch 204 is of the proper level, and the oil temperature is below 170° F. so that temperature switch 208 is open, relay contacts 328 and 334 will be closed. Switch 342 is depressed, thereby activating motor control relay 346 starting the motor 234 to drive hydraulic pump 232. Switch 360 is depressed, thereby activating motor control relay 364, which starts motor 252 to drive hydraulic pump 250. This, then, closes relay contacts 382 and 384 to supply power to the chipper. Switch 394 then is depressed to allow power to go to line 420 by closing relay contact 418. The shredder motor begins operating in a forward direction because power is supplied through relay contact 426 to the forward solenoid 270. This continues until timer 430 times out, whereupon control relay 438 is energized and power is supplied through relay contact 428 to the reverse solenoid 272. This continues until timer 432 times out. Should an overload condition be experienced in the forward direction, switch 292 closes, supplying power timer relay 440. This causes the hydraulic motor to operate in a reverse direction until timer 440 times out or until an overload condition is detected by pressure switch 296. Should pressure switch 296 detect an overload condition, timer relay 444 is energized, thereby opening relay contact 436 de-energizing control relay 438 and placing the motor in a forward rotational direction. The shredder, therefore, continues to cycle in forward or reverse until the overload conditions are eliminated. Once the overload conditions are eliminated, the motor then reverts to normal forward and reverse cycling.

Having illustrated and described the principles of the invention in a preferred embodiment, it should be apparent to those skilled in the art that the invention can be modified in arrangement and detail without departing from such principles. We claim all modifications coming within the spirit and scope of the following claims.

We claim:

1. A shredder for reducing the size of material comprising:

a frame having a first side, a second side, a top opening and a bottom opening, said top opening adapted to receive material to be shredded and said bottom opening adapted to discharge shredded material;

a shaft mounted in said frame and adapted to rotate within said frame;

a plurality of toothed blades mounted on said shaft and adapted to rotate with said shaft;

a first plurality of shear bars fixedly mounted on the first side of said frame;

a second plurality of shear bars fixedly mounted on the second side of said frame; and a motor means to rotate the shaft in a first forward rotational direction to bring the blades into cooperative shredding relationship with the first plurality of shear bars;

said motor means also operating to rotate the shaft in a second reverse rotational direction to bring the blades into cooperating shredding relationship with the second plurality of shear bars;

each toothed blade having plural cutting teeth spaced about the periphery thereof, the cutting teeth each having a pair of cutting edges adapted to shred material bi-directionally, each toothed blade having a maximum diameter defined by said cutting teeth and a minimum diameter defined by recessed portions located between said cutting teeth, said toothed blades being arranged in an alternating pattern on said shaft such that every other tooth blade has a maximum diameter which is substantially equal to the minimum diameter of said adjacent toothed blade;

the motor means including a reversible hydraulic motor; and control means cooperable with said motor means for rotating the shaft and toothed blades mounted thereto alternately in the first forward direction for a predetermined period of time to shred material and then in the second reverse direction for said predetermined time to shred material, without regard to whether a jam condition exists, whereby the shredder on average shreds the same amount of material in the forward direction as the reverse direction, said control means including means for detecting a jam condition when said shaft is rotating in the forward direction and when said shaft is rotating in the reverse direction, and thereupon reversing the direction of rotation of the shaft.

2. A shredder as recited in claim 1 wherein the motor means further includes;

a) a first pressure detection means to detect an overload condition of said motor in the first direction of rotation of the shaft and to reverse the rotation of the motor at the completion of a third time period after said overlaod condition has been detected; and b) a second pressure detection means to detect an overload condition of the motor in the second direction of rotation of the motor and to reverse the rotation of the motor at the completion of a fourth time period after said overload condition has been detected.

3. A shredder for reducing the size of material comprising:

a) a frame having a top opening, a bottom opening, a first side and a second side b) a shaft mounted in said frame equidistant from said first side and said second side;

c) a first set of blades mounted on said shaft;

d) a second set of blades mounted on said shaft, said first set of blades having a maximum diameter less than the maximum diameter of said second set of blades;

e) the first set of blades being mounted between the second set of blades in an alternating pattern;

f) a first set of shear bars mounted on the first side of said frame;

g) a second set of shear bars mounted on the first side of said frame;

h) a shear bar of said first set of shear bars mounted adjacent a shear bar of said second set of shear bars in side to side relationship alternately along the first side of said frame;

i) a first set of shear bars mounted on the second side of said frame;

j) a second set of shear bars mounted on the second side of said frame;

k) a shear bar of said first set of shear bars mounted adjacent a shear bar of said second set of shear bars in side to side relationship alternately along said second side of said frame;

l) a shear bar of the first set of shear bars attached to the first side of the frame and a shear bar of the first set of shear bars attached to the second side of the frame cooperating with one of the first set of blades attached to said shaft;

m) a shear bar of the second set of shear bars attached to the first side of the frame and a shear bar of the second set shear bars attached to the second side of the frame cooperating with one of the second set of blades attached to said shaft;

n) a motor means to rotate the shaft; and o) control means cooperable with said motor means for rotating the shaft and toothed blades mounted thereto alternately in the first forward direction for a predetermined period of time to shred material and then in the second reverse direction for said predetermined time to shred material, without regard to whether a jam condition exists, whereby the shredder on average shreds the same amount of material in the forward direction as the reverse direction, said control means including means for detecting a jam condition when said shaft is rotating in the forward direction and when said shaft is rotating in the reverse direction, and thereupon reversing the direction of rotation of the shaft.

* * * * *

UNITED STATES PATENT AND TRADEMARK OFFICE

CERTIFICATE OF CORRECTION

PATENT NO. : 5,052,630

DATED : October 1, 1991

INVENTOR(S) : Michael E. Hinsey, et al.

It is certified that error appears in the above-identified patent and that said Letters Patent is hereby corrected as shown below:

Column 5, line 41 "30°"
should be --30--;

Column 9, line 57 "sWitch"
should be --switch--;

Column 10, line 53 "will
lit" should be --will remain lit.--;

Column 14, line 56 "includes;"
should be --includes:--;

Column 14, line 61 "overlaod"
should be --overload--;

Column 15, line 4
line 7), "side" should be --side;--;

Column 16, line 10 claim 3, last
line , "set shear" should be --set of shear--.

Signed and Sealed this

Fifteenth Day of June, 1993

*Attest:*

*Attesting Officer*

Michael K. Kirk

MICHAEL K. KIRK

*Acting Commissioner of Patents and Trademarks*